United States Patent [19]

Hecht et al.

[11] Patent Number: 4,630,544

[45] Date of Patent: Dec. 23, 1986

[54] ACTUATING MECHANISM IN OVERHEAD RAIL EQUIPMENT

[75] Inventors: Joachim Hecht, Mettmann; Gerhard Rudat, Hagen, both of Fed. Rep. of Germany

[73] Assignee: Mannesmann AG, Duesseldorf, Fed. Rep. of Germany

[21] Appl. No.: 551,567

[22] Filed: Nov. 14, 1983

[30] Foreign Application Priority Data

Nov. 11, 1982 [DE] Fed. Rep. of Germany ..... 3241626

[51] Int. Cl.[4] ..... B61B 13/04

[52] U.S. Cl. ..... 105/130; 104/93; 105/150; 192/24; 192/94

[58] Field of Search ..... 104/89, 93, 287, 288, 104/303, 249, 250, 295, 300; 192/94, 22, 24, 25; 105/148, 150, 130, 268; 200/61.44

[56] References Cited

U.S. PATENT DOCUMENTS

| | | | |
|---|---|---|---|
| 469,206 | 2/1892 | Geb | 192/24 |
| 860,590 | 7/1907 | Williams | 192/94 |
| 1,496,598 | 6/1924 | Rabinowitz | 200/61.44 |
| 1,675,165 | 6/1928 | Custer | 104/288 |
| 2,465,054 | 3/1949 | Berg | 192/94 |
| 3,001,620 | 9/1961 | Olchawa | 192/24 |
| 4,244,455 | 1/1981 | Loker | 192/24 |

FOREIGN PATENT DOCUMENTS

| | | | |
|---|---|---|---|
| 2822984 | 12/1978 | Fed. Rep. of Germany | 192/22 |
| 0011106 | 1/1902 | Norway | 192/24 |

*Primary Examiner*—Robert B. Reeves
*Assistant Examiner*—Dennis C. Rodgers
*Attorney, Agent, or Firm*—Ralf H. Siegemund

[57] ABSTRACT

The drive motor of a vehicle running on an overhead rail and being drivingly coupled thereto through a drive wheel is selectively connected to and disconnected from that wheel through a coupling mechanism which is constructed for obtaining coupling and disconnection through axial movement, being in turn obtained through rotational adjustment under utilization of a control disk having axially extending pins and being part of the vehicle equipment but cooperating with stationary actuating pieces arranged along the track in appropriate positions to obtain selective connection and disconnection of the drive shaft by engaging these pins and turning the coupling mechanism in one direction or the other.

10 Claims, 2 Drawing Figures

A

ACTUATING MECHANISM IN OVERHEAD RAIL EQUIPMENT

BACKGROUND OF THE INVENTION

The present invention relates to overhead trolley or other vehicle equipment including a rail for supporting a vehicle having a drive wheel which can be selectively connected and disconnected from a motor or engine. Equipment of the type to which the invention pertains is disclosed, for example, in the German Pat. No. 28 02 401. In this patent structure is disclosed for rendering the engine or motor ineffective whenever the vehicle is to be dragged, for example, by means of chains. Such auxiliary manner of driving the vehicle is necessary, for example, in case of inclinations which the vehicle's own motor is not able to accommodate, or in case the vehicle passes through areas, spaces, rooms or the like in which there is the danger of explosion. The known overhead rail and vehicle equipment requires supplemental rails as well as supplemental running wheels for lifting the driven wheel of the vehicle off the rail. This, of course, entails considerable expenditure of capital investment.

DESCRIPTION OF THE INVENTION

It is an object of the present invention to provide a new and improved device, structure and mechanism for connecting and disconnecting the drive of a vehicle in an overhead rail system to and from the respective motor.

In accordance with the preferred embodiment of the invention, it is suggested to provide a coupling to be actuated by means of a rotating or turning device having two projecting pins, and switch or actuating elements are arranged along the rail; as far as the direction of movement of the vehicle is concerned, these switching and actuating elements or pieces are alternatingly arranged above and below the axis of turning of the rotating or turning device as it pertains to the vehicle. These actuating and switching elements are stationary, as are the rails. Whenever the vehicle is to change the mode of driving, it runs, in fact, by means of one of these pins against the respective switching and actuating element whereby, for example, the beginning of a drag track causes, by means of such pin operating piece arrangement, the disconnection of the drive wheel or wheels from the motor in the vehicle so that now a chain drive can take over. Analogously, at the end of this drag track portion, the switching operation is reversed. The switching and actuating operation involves directly the release and actuation of the aforementioned coupling.

In accordance with a further feature of the invention, these actuating pieces or elements are oriented to have actuating surfaces facing the approaching vehicle and run-off surfaces facing the axis of the drive wheel but receding in the direction of movement of the vehicle. These run-off and receding surfaces do not quite reach the axis so that the previously activated pin can, in fact, slide off the respective actuating piece.

In furtherance of the invention the pins are arranged upon a control or cam disk being combined with a threaded annulus which is rotatably positioned in a cover of an equipment under utilization of a rather step-pitched thread. This way, the armature becomes axially slidable for purposes of operating a clutch or coupling. For example, if a switching element that is stationary along the rail causes a turning of this cam or control disk by about 80°, the step-pitched thread will produce sufficiently large axial displacement of a movable coupling element as is necessary for operating the clutch in the vehicle in one way or the other.

In accordance with another feature of the present invention, the control or cam disk is rotatable with respect to the threaded annulus for purposes of compensating and adjusting the system to existing tolerances. After this threaded annulus has been adjusted in the stated manner, the control and cam disk is placed into the proper position and subsequently locked by means of a clamping sleeve in order to avoid subsequent undesired turning. Another clamping sleeve or stop member extends from the aforementioned cover into a circular, segment type groove in the control and cam disk in order to limit rotation thereof. Here, the groove is somewhat longer than necessary for obtaining the respective coupling effect. Beyond that aspect, the latter clamping sleeve prevents further turning of the threaded annulus because the latter basically is amenable to being unscrewed, unless such locking is provided for.

The threaded annulus forces a coupling ring against a worm gear. The action is carried under utilization of disk-shaped springs. The coupling ring is splined to the shaft of the drive wheel. The worm gear is connected through suitable gearing to the motor or engine of the vehicle. The operating surface of the coupling ring may have conical configuration forced into a matching contour of the worm gear. Preferably, a thrust mount for the coupling ring, and more particularly for the disk springs, may be provided at the threaded annulus.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 illustrates a rail 1 of general construction and provided for overhead suspension-type equipment, and pertaining as a stationary part to such a system. The vehicle that runs on rail 1 is generally denoted by reference character 100, and it includes a drive wheel 2 by means of which frictional engagement is established between rotational equipment of the vehicle and the rail 1. Reference numeral 3 refers generally to centering and guiding wheels 3 of the suspension structure which are suitably journaled in the vehicle. The drive motor for the vehicle is not shown but is coupled to a worm gear 4 meshing a gear 5 so that the latter rotates and through this rotation it drives a coupling ring 6 having a conically shaped coupling surface 6a. The coupling ring 6 is splined to the shaft 8 of the drive wheel 2. The spline connection is denoted by reference numeral 7. Thus, elements 5 and 6 establish a coupling for establishing a drive train motor-4-5-6-7-8-2.

Figures 1, 2:
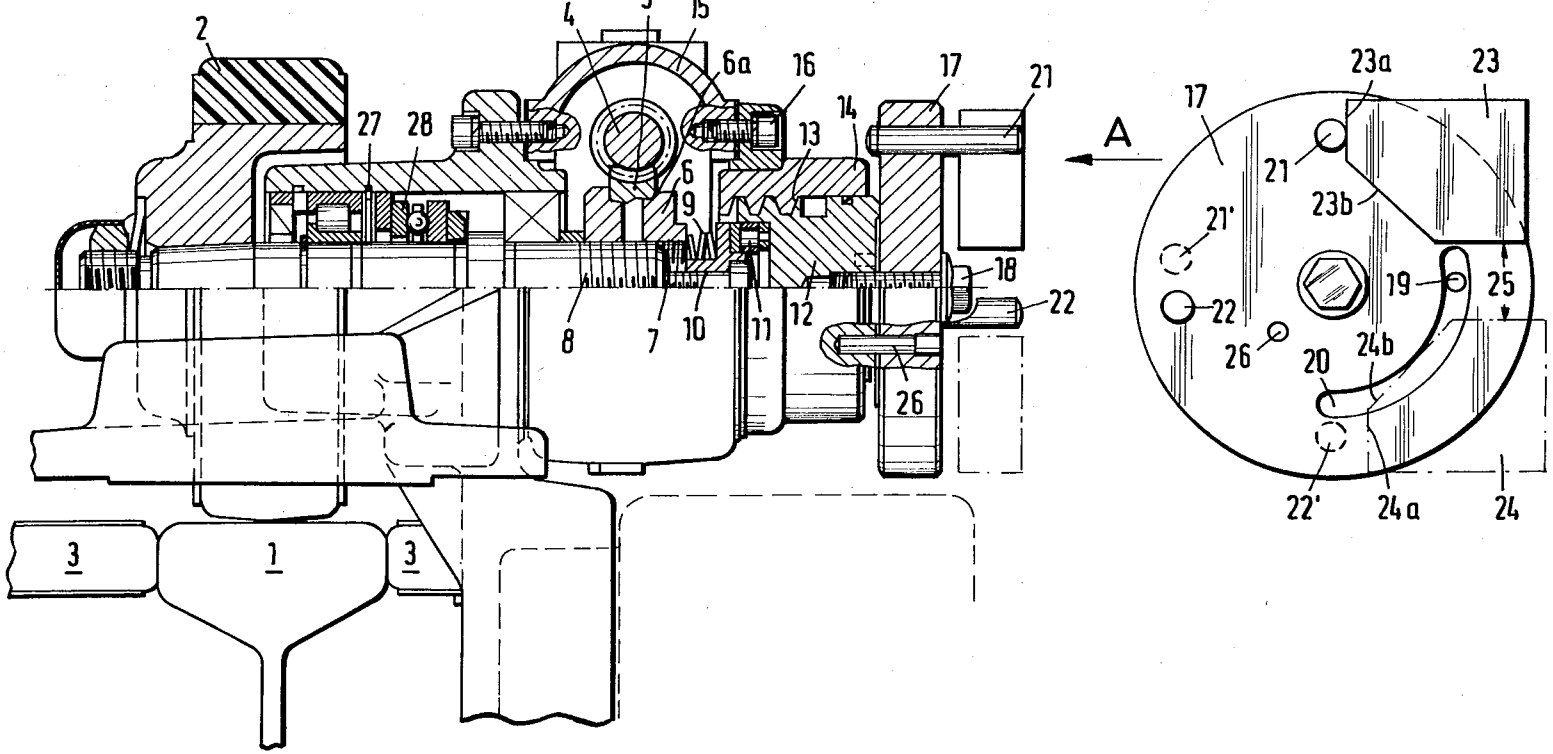
FIG. 1 is a cross section through a portion of the drive system of a vehicle that runs on an overhanging rail, the illustration being restricted to the elements relevant for the invention.
FIG. 2 illustrates a side view indicated by arrow A in FIG. 1.

In order to release the coupling ring 6 through its coupling surface 6a from the matching countersurface of the gear 5, disk springs 9 are stress relieved by means of a receding thrust bearing or mount 10. In the advanced position, these springs 9, urge against the ring 6 against gear 5. The thrust mount 10 bears against a threaded annulus 12 via pressure bearing structure 11. The threaded annulus 12 is provided with a step pitch threading 13 and is threaded in that manner into a cover 14. This cover 14 is bolted by means of screws 16 to the equipment casing 15. This mode of positioning renders the threaded annulus 12 axially adjustable.

A control and cam disk 17 is provided in front of and connected to the threaded annulus 12 by means of a screw 18. A clamping sleeve 26 secures the position of the control and cam disk 17 on annulus 12. This locking function is provided after the springs 9 have been pretensioned.

FIG. 2 illustrates a circularly segment-type groove or aperture 20 in the control and cam disk 17; it limits the operating range for the clamping sleeve 19. This way, cam and control disk 17 and annulus 12 can undergo only very limited turning in relation to the cover 14. The clamping sleeve 26, prevents turning of the control disk 17 in relation to the threaded annulus 12; sleeve 19 coacting with aperture 20 limits rotational displacement of the assembly 12, 17 to the angular range given by aperture 20.

Two pins 21 and 22 extend axially from the control disk 17. These pins 21 and 22 are provided for turning the threaded annulus 12. The turning of the annulus 12 is effective as an axial movement of the coupling ring 6 and its relation to the gear 5. This way one obtains selective coupling or connection and disconnection of the drive in relation to the drive wheel 2.

Thus far equipment associated with the rolling stock has been described. Reference is now made to the actuating elements which are stationary and with which these pins 21 and 22 selectively cooperate. These actuating elements or pieces 23 and 24 are stationary as stated and mounted in particular spatial association with the rail 1. Herein, actuating element 23 is disposed above the axis of shaft 8 for the coupling mechanism as well as the drive wheel 2. This actuating piece 23 cooperates with the pin 21 and the composite function is to effect a connection within the coupling to obtain dragging connection between the motor and the wheel, i.e. between the shaft 4 and the shaft 8.

The actuating piece 24 is disposed below the axis of shaft 8 of the passing vehicle and it cooperates with the pin 22 in order to provide for the disconnect function. FIG. 2 illustrates both pieces, 23 and 24. In reality, of course, they are never placed next to each other but quite apart along the extension of the track rail 1.

The two pins 21 and 22 are angularly spaced apart with respect to the axis 8 by an angle of about 100° whereby normally one of the pins is disposed basically above (or below) the axis of shaft 8 while the other one is in approximately the same horizontal level as the axis of the shaft 8.

The pieces 23 and 24 have first operating surfaces respectively 23a and 24a which are generally vertically oriented and face the arriving vehicle. Moreover, each of these pieces 23 and 24 has runoff surfaces 23b and 24b, which as seen in the direction of movement of the vehicle recede from the rolling equipment but face the passing axis of shaft 8. This way, a certain space 25 is provided permitting passage of that particular pin, 21 or 22, which was just effective in an actuating manner. Pin 21 assumes position 21' as it turns the control disk 17 which, of course, occurs early as the pin is in effect actuated by a control and cam piece 23. Analogously, a control piece 24 may move the pin 22 into the position 22'.

Without intending to restrict application of the inventive principle, generally a cam and control piece 24 will be provided for purposes of effecting a disconnect function of the coupling in the beginning of a drag brake portion in which driving of the vehicle is to be carried out subsequently by appropriate dragging equipment. As seen in the direction of vehicle motion a control and actuating piece 23 is provided at the end of the drag track in order to obtain a reconnection between the driving shaft 4 and the driven shaft 8.

The drag equipment is not illustrated, but it will be understood that conventional equipment can be used here arranged such that it becomes coupled to the vehicle just a little ahead of the position of a control piece 24 which will then actuated the pin 22 of the vehicle. Analogously, the drag drive is to be disconnected from the vehicle shortly after a piece 23 has actuated the pin 22 to effect reconnection of the shaft 4 to the shaft 8. These aspects can best be seen from FIG. 2. Following the reconnection of the shaft 4 and 8 to each other, the vehicle will continue to move by means of its own drive.

The control and cam element 24 is illustrated in dash/dot lines in the drawing but as stated it is actually shown provided at a different position as far as the drawing is concerned. The positioning of the control and actuating pieces 23 and 24 can be provided for very accurately phasing and timing the changeover of one type of drive to the respective other one. In this regard it has to be considered that the vehicle will usually run somewhat faster by means of its own drive than it will run when the drag drive takes over. This means that the vehicle will enter the drag rail portion without incurring any problems and upon leaving the takeover of the driving by the vehicles own drive won't present any problems.

The invention is not limited to the embodiments described above but all changes and modifications thereof not constituting departures from the spirit and scope of the invention are intended to be included.

We claim:

1. Overhead equipment including a rail means for suspending a vehicle, there being a drive wheel on the vehicle running on the rail, the vehicle having a motor driven shaft, the drive wheel having a shaft, there being a coupling interposed between the motor driven shaft and the shaft for the drive wheel, an actuating system comprising:

the coupling being constructed for obtaining connection and disconnection through rotational motion of one of its parts, there being a pair of pins extending axially from said part in a particular angularly spaced relation to each other;

at least one first actuating piece arranged along the rail at a relative disposition in relation to a passing vehicle so as to engage one of the pins for turning the rotational part of the coupling in one direction to cause the coupling to connect the two shafts; and at least one second actuating piece also arranged along said rail at a relative disposition to a passing vehicle so as to engage the other one of the pins to thereby effect an oppositely effective turning motion of the rotatable part of the coupling to obtain disconnection between the two shafts.

2. A mechanism as in claim 1 wherein each of these actuating pieces has a first, pin-engaging operating face facing generally in the direction of movement of the vehicle and a second obliquely oriented run-off surface which as seen in the direction of movement of the vehicle recedes in that direction but faces the axis of rotation of said rotational part but without reaching the axis itself.

3. An actuating mechanism as in claim 1 and including:

an equipment case pertaining to the vehicle;

a cover on the equipment case;

a threaded annulus pertaining to the one part and being rotatably threadably connected to the cover for being axially moveable in relation to the axis of the drive wheel upon turning for obtaining connection and disconnection of the coupling; and a control disk on the threaded annulus carrying said pins.

4. An actuating mechanism as in claim 3, said threaded annulus acting against a coupling ring being splined to the shaft of the drive wheel, there being a worm gear included in the drive shaft meshing a gear having an operating surface cooperating with said coupling ring.

5. An actuating mechanism as in claim 4, wherein said operating surfaces of the coupling are of conical configuration.

6. An actuating mechanism as in claim 4, there being a thrust mount engaging said threaded annulus, there being disk springs arranged for action on and by the thrust mount and acting upon said coupling ring.

7. An actuating mechanism as in claim 6, including means connected for reacting the pressure force as provided by the thrust mount into the case.

8. An acuating mechanism as in claim 3, said threaded annulus and said control disk being rotatably positionable in relation to each other, there being locking means for retaining an adjusted position.

9. An actuating mechanism as in claim 8, the locking means including a clamping sleeve extending from the control disk into the threaded annulus.

10. An actuating mechanism as in claim 3, including a stop member secured to the cover, the control disk having a circular segment-type groove, the stop member extending into the groove to thereby limit any angular movement of the disk.

* * * * *